US008939616B1

(12) United States Patent
Baldwin et al.

(10) Patent No.: US 8,939,616 B1
(45) Date of Patent: Jan. 27, 2015

(54) LIGHT FIXTURE WITH PRIVACY SHROUD

(75) Inventors: Jeffrey P. Baldwin, Phoenix, AZ (US); Richard L. Cleghorn, Tempe, AZ (US); Marcus J. Shotey, Scottsdale, AZ (US); Thomas A. Miserendino, Gilbert, AZ (US)

(73) Assignee: Hubbell Incorporated, Shelton, CT (US)

( * ) Notice: Subject to any disclaimer, the term of this patent is extended or adjusted under 35 U.S.C. 154(b) by 780 days.

(21) Appl. No.: 13/011,039

(22) Filed: Jan. 21, 2011

Related U.S. Application Data

(60) Provisional application No. 61/363,370, filed on Jul. 12, 2010.

(51) Int. Cl.
*F21V 17/16* (2006.01)

(52) U.S. Cl.
USPC ..... 362/361; 362/439

(58) Field of Classification Search
USPC ..... 362/437, 351, 353, 355, 356, 361, 438, 362/439
See application file for complete search history.

(56) References Cited

U.S. PATENT DOCUMENTS

| | | | | |
|---|---|---|---|---|
| 5,377,087 | A * | 12/1994 | Yoon | 362/275 |
| 5,560,707 | A * | 10/1996 | Neer | 362/376 |
| 6,280,071 | B1 * | 8/2001 | Yamamoto et al. | 362/539 |
| 2010/0328960 | A1 * | 12/2010 | Wang | 362/373 |

FOREIGN PATENT DOCUMENTS

KR 20080098762 A * 11/2008

* cited by examiner

*Primary Examiner* — Jong-Suk (James) Lee
*Assistant Examiner* — Leah S Macchiarolo
(74) *Attorney, Agent, or Firm* — Roylance, Abrams, Berdo & Goodman, L.L.P.

(57) ABSTRACT

A light fixture including a housing having a wall extending from a bottom surface to a top surface and forming an opening, a socket proximate the bottom surface for receiving an illumination source, and a shroud removably secured to and extending away from the top surface. The shroud may include at least one protrusion extending from a rear surface and connectable to a housing top surface ridge.

17 Claims, 3 Drawing Sheets

LIGHT FIXTURE WITH PRIVACY SHROUD

CROSS REFERENCE TO RELATED APPLICATIONS

This application claims the benefit of the filing date of U.S. Provisional Patent Application 61/363,370 entitled "Privacy Shroud" to Jeffrey P. Baldwin which was filed on Jul. 12, 2010, the contents of which are hereby incorporated herein by reference.

BACKGROUND

1. Technical Field

Aspects of this document relate generally to indoor and outdoor light fixtures with a privacy shroud.

2. Background Art

Light fixtures are used in a variety of locations, both indoors and outdoors, to secure light bulbs at night. Traditional light fixtures have been built and designed for incandescent light bulbs and the generally smaller size of the incandescent light bulbs prevented light pollution. Light pollution is excessive or obtrusive artificial light. A number of municipalities require that outdoor lighting be partially or fully shielded. Essentially, the light fixture must shield surrounding areas from light spilling onto adjoining properties.

In an effort to reduce energy consumption, compact florescent lamps (CFL) have been introduced to replace generally inefficient incandescent light bulbs. However, the compact florescent lamps are generally larger than an incandescent light bulb because the CFL requires electronic ballasts. Thus, the CFL bulbs are larger and extend further out of the light fixtures. Any light fixtures manufactured for incandescent light bulbs may be able to house a CFL bulb, but the added height of the CFL bulb means that the bulb may extend beyond the outer edge of the light fixture and create light pollution. With longer light fixtures, an incandescent bulb will not be as effective because the bulb will be too deep within the light fixture.

SUMMARY

Aspects of this document relate to light fixtures. In one aspect, a light fixture includes a housing having a wall extending from a bottom surface to a top surface and forming an opening, a socket proximate the bottom surface for receiving an illumination source, and a shroud removably secured to and extending away from the top surface.

Particular implementations may comprise one or more of the following features. The shroud may further include at least one protrusion extending from a rear surface and connectable to a housing top surface ridge. The at least one protrusion may abut a rear side of the top surface ridge. The at least one protrusion may further include a plurality of protrusions. The at least one protrusion may be spaced apart from the rear surface by a tab. The shroud may further include a stop extending from the rear surface. The stop may be spaced apart from the rear surface by an arm. The stop may extend radially inward from the shroud rear surface. The stop may contact a front side of the top surface ridge. The shroud may include a thickness approximately equal to a visible portion of a compact florescent light secured within the socket. The shroud thickness may be between 0.25 inches and one inch. The shroud thickness is between 0.5 inches and 1.5 inches. The shroud may be composed of a flexible plastic. The shroud may be composed of a rigid plastic. The shroud may include a first stop and a second stop. The housing top surface ridge may be located between the shroud first and second stops. The shroud may include a plurality of protrusions and a plurality of stops extending from a shroud rear surface. The protrusions and stops may alternate around the shroud. The first and second stops are continuously disposed on a shroud inner surface. The shroud may be angled outward.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Embodiments of the present invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended operation and assembly procedures for a light fixture will become apparent for use with implementations of a light fixture from this disclosure. Accordingly, for example, although particular components are disclosed, such components and other implementing components may comprise any shape, size, style, type, model, version, measurement, concentration, material, quantity, and/or the like as is known in the art for such implementing components, consistent with the intended operation of a light fixture.

Figure 1:
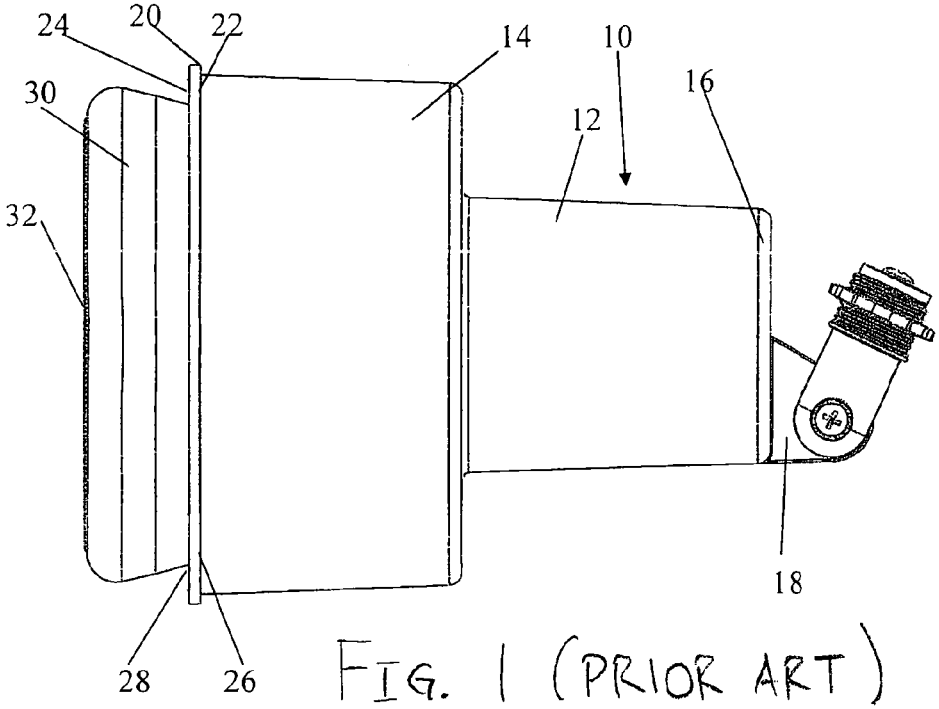
FIG. 1 (PRIOR ART)
FIG. 1 is a right side elevation view of an outdoor light fixture of the prior art with a compact florescent lamp installed.

FIG. 1 illustrates a prior art light fixture 10 having a housing with a lower portion 12 and an upper portion 14. Light fixture 10 may be generally round in shape with a smaller diameter at lower portion 12 than upper portion 14, although the housing may have any suitable shape or size. Lower portion 12 includes a bottom surface 16 with a pivotal mount 18 for securing the light fixture to a building or other structure. Upper portion 14 includes a top surface 20 with a top surface ridge 22. Top surface ridge 22 also includes a front side 24 and a rear side 26 extending radially outward from upper portion 14. An opening 28 is formed in top surface 20 and extends downward through upper portion 14 and lower portion 12.

Opening 28 is arranged to receive an illumination source, such as compact florescent lamp (CFL) 30 during operation. Specifically, light fixture 10 includes a socket (not shown) traditionally known in the art proximate bottom surface 16 for threadably receiving an illumination source. As can be seen in FIG. 1, when CFL 30 is inserted within light fixture 10, a crown or end 32 of the CFL extends beyond top surface 20 when the CFL 30 is fully seated in the socket.

Figure 2:
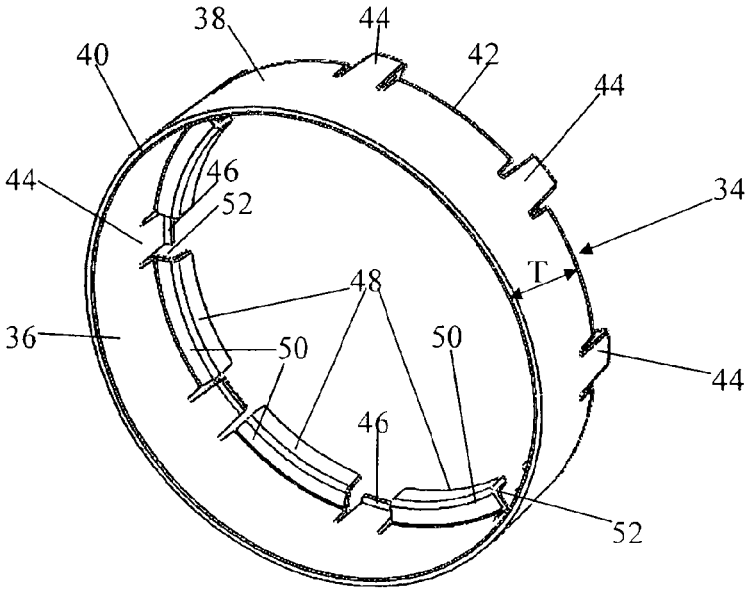
FIG. 2 is a perspective view of a privacy shroud.

FIG. 2 illustrates a privacy shroud 34 having an inner surface 36, an outer surface 38, a front surface 40, and a rear surface 42. Shroud 34 may be angled outward and include a thickness T of anywhere between ¼ (0.25) inches and 2 inches, and particularly between 0.25 inches and 1 inch or 0.5 inches and 1.5 inches. A plurality of tabs 44 extend rearward from rear surface 42 and terminate in protrusions 46. Protrusions 46 extend radially inward and may be movable due to any flexibility in tabs 44. While a plurality of tabs and protrusions are shown and described, any suitable number of tabs and protrusions may be utilized, including only one or two of each. Privacy shroud 34 may be composed of a flexible plastic, a rigid plastic, or a composite of various plastic materials if tabs 44 need to be flexible. Regardless, privacy shroud 34 functions the same regardless of the material composition and no particular material composition or properties is to be implied as required by this description.

Rear surface 42 and inner surface 36 may also include a plurality of stops 48 spaced radially inward from inner surface 36 by a plurality of arms 50. Stops 48 and arms 50 are shown and described as a plurality, although any suitable number may be utilized. Stops 48 and arms 50 may rest against top surface 20 and partially within opening 28 such that front side 24 of top surface ridge 22 contacts a notch 52 at least partially formed by each stop 48 and arm 50. In one implementation, each stop and arm set alternates with each tab and protrusion set throughout the circumference of the privacy shroud. In this arrangement, a large number of protrusions are used to secure privacy shroud 34 to light fixture 10. As discussed above, a larger number of, or larger in size versions of stops 48 and arms 50 contact more of light fixture 10 and thus the privacy shroud needs fewer tabs and protrusions. For example, it may be easier to remove privacy shroud if only 1, 2, or 4 tabs need to be bent in order to remove the privacy shroud.

Figure 3:
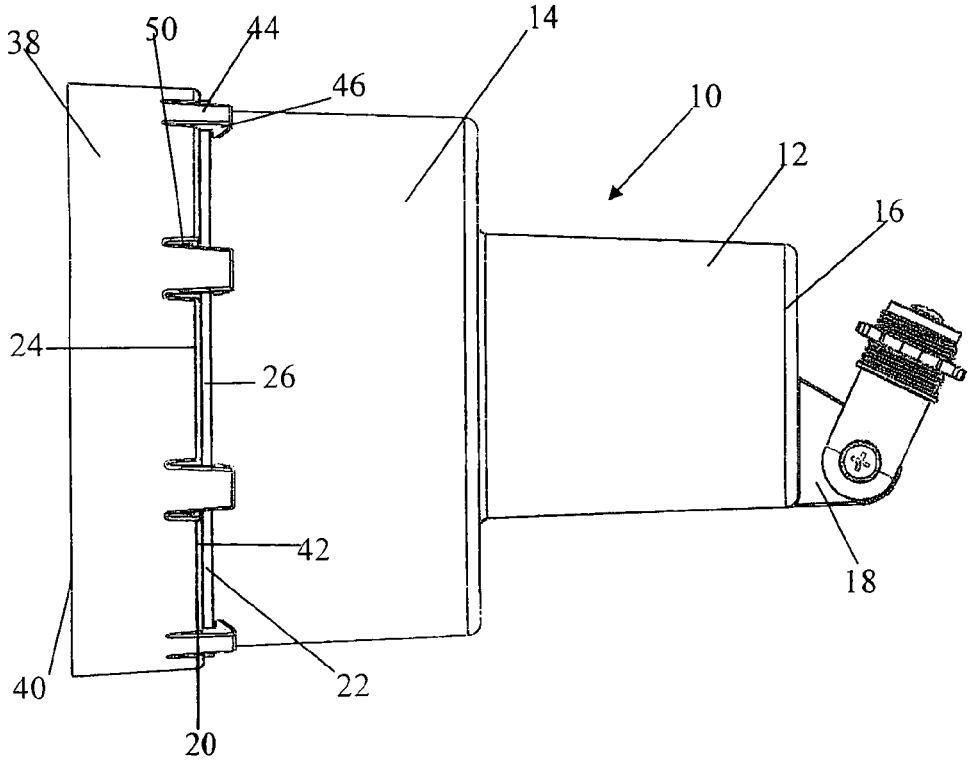
FIG. 3 is a right side elevation view of an outdoor light fixture with a privacy shroud installed.

FIG. 3 illustrates privacy shroud 34 secured to light fixture 10. Privacy shroud 34 is removably secured to top surface 20 of light fixture 10 with tabs 44 and protrusions 46 while stops 48 and arms 50 limit the distance the shroud will travel on the light fixture. Specifically, privacy shroud 34 is installed on light fixture 10 until stops 48 and arms 50 contact front side 24 of top surface 20 and top surface ridge 22. During that installation, protrusions 46 are biased radially outward at tabs 44 by top surface ridge 22 and ultimately contact upper portion 14 after protrusions 46 pass top surface ridge 22. After protrusions 46 pass top surface ridge 22, protrusions 46 contact a back side 26 of top surface ridge 22 and prevent privacy shroud 34 from being removed inadvertently.

As discussed above, stops 48 and arms 50 limit movement of the privacy shroud toward lower portion 12 and therefore privacy shroud 34 may be properly located when protrusions 46 contact back side 26 of top surface ridge 22 and stops 48 contact top surface ridge front side 24. Although the implementations of the privacy shroud discuss contacting both the front and back side of top surface ridge 22, there may be enough tolerance to permit a small amount of privacy shroud movement during normal operation. In order to remove privacy shroud 34 from light fixture 10, the user may pull up on tabs 44 to pull protrusions 46 outward above top surface ridge 22 and allow the privacy shroud to be completely removed from light fixture 10. In the cases where multiple sets of tabs 44 and protrusions 46 are disposed on privacy shroud 34, all of the tabs must be pulled outward, potentially in unison, in order to release the protrusions and the privacy shroud.

Figure 4:
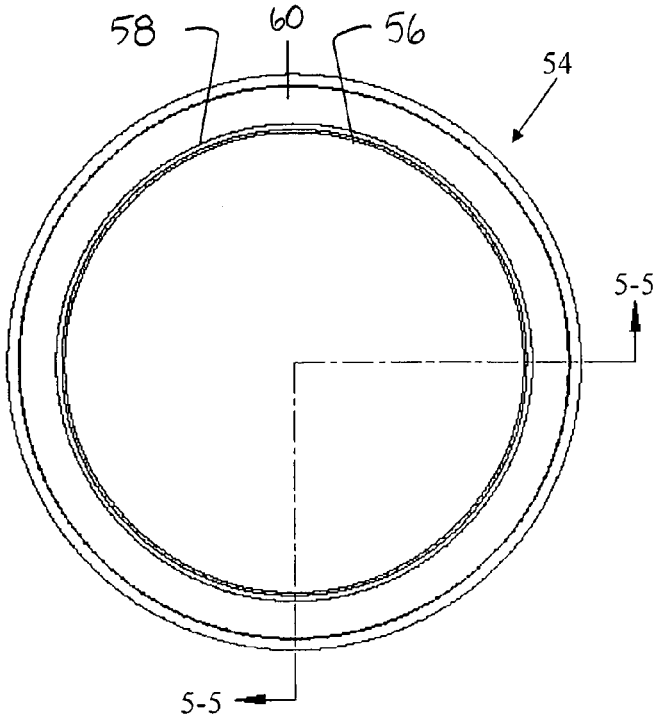
FIG. 4 is a front plan view of a privacy shroud.
Figure 5:
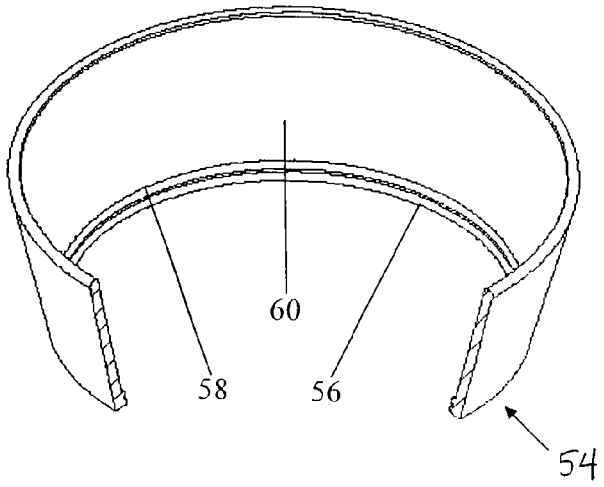
FIG. 5 is a sectional view taken generally about line 5-5 in FIG. 4.

FIGS. 4 and 5 illustrate a second implementation privacy shroud 54 with a first stop 56 and a second stop 58 extending inward from an inner surface 60. The first and second stops may be spaced apart from one another slightly larger than the distance from top surface ridge front side 24 and back side 26 (see FIGS. 1 and 3). Accordingly, privacy shroud 54 is inserted onto light fixture 10 until first stop 56 traverses back side 26 of top surface ridge 22. After first stop 56 has passed top surface ridge 22, the top surface ridge 22 is secured between first stop 56 and second stop 58. Advantageously, if first stop 56 and second stop 58 are continuous throughout the circumference of inner surface 60, then there is little or no possibility of light pollution escaping between light fixture 10 and privacy shroud 54. Further, first stop 56 is preferably sized to be removed from light fixture 10 when sufficient pressure is applied, but to remain in place on the light fixture when only minimal pressure is applied. While privacy shroud 54 is shown and described with first stop 56 and second stop 58 being continuous throughout the circumference of inner surface 60, any suitable number of stops may be utilized on the privacy shroud inner surface. Similar to privacy shroud 34, privacy shroud 54 is removably secured to light fixture 10 and effectively increases the overall length of opening 28 in light fixture 10 to adequately surround a compact fluorescent bulb during operation to reduce or eliminate any unwanted light pollution.

It will be understood that implementations are not limited to the specific components disclosed herein, as virtually any components consistent with the intended operation of a method and/or system implementation for a light fixture may be utilized. Accordingly, for example, it should be understood that, while the drawing figures and accompanying text show and describe a round light fixture, a light fixture of the present disclosure may contain any number of sides. Common light fixture shapes also include round, square, and octagonal. However, a light fixture of the present invention may also be other shapes. Components may comprise any shape, size, style, type, model, version, class, grade, measurement, concentration, material, weight, quantity, and/or the like consistent with the intended operation of a method and/or system implementation for a light fixture.

The concepts disclosed herein are not limited to the specific implementations shown herein. For example, it is specifically contemplated that the components included in a particular implementation of a light fixture may be formed of any of many different types of materials or combinations that can readily be formed into shaped objects and that are consistent with the intended operation of a light fixture. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments of the light fixture may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations of a light fixture, it should be readily apparent that a number of modifications may be made without departing from the spirit thereof and that these implementations may be applied to other light fixtures. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A light fixture, comprising:

a housing having a wall extending from a bottom surface to a top surface and forming an opening, a top surface ridge having upper and lower surfaces being connected to the top surface externally of said housing;

a socket proximate the bottom surface for receiving an illumination source; and, a shroud removably secured to and extending away from the top surface, the shroud including at least one protrusion extending from a rear surface of the shroud and engaging the lower surface of the top surface ridge to substantially prevent removal of the shroud from the housing, a free end of the at least one protrusion being disposed externally of the opening; and at least one stop extending from and spaced apart from the rear surface of the shroud by an arm adjacent the at least one protrusion and engaging the upper surface of the top surface ridge to limit movement of the shroud toward the socket, a free end of the at least one stop being disposed within the opening.

2. The light fixture of claim 1 wherein the at least one protrusion further comprises a plurality of protrusions.

3. The light fixture of claim 1 wherein the at least one protrusion is spaced apart from the rear surface by a tab.

4. The light fixture of claim 1 wherein the at least one stop extends radially inward from the shroud rear surface.

5. The light fixture of claim 1 wherein the illumination source is a compact fluorescent light and where the shroud extends from the top surface of the housing a distance to cover the compact fluorescent light secured within the socket extending past the end of the housing.

6. The light fixture of claim 5 wherein a shroud length is between 0.25 inches and one inch.

7. The light fixture of claim 5 wherein a shroud length is between 0.5 inches and 1.5 inches.

8. The light fixture of claim 1 wherein the shroud is composed of a flexible plastic.

9. The light fixture of claim 1 wherein the shroud is composed of a rigid plastic.

10. The light fixture of claim 1 wherein the shroud further comprises a plurality of said protrusions and a plurality of said stops extending from a shroud rear surface.

11. The light fixture of claim 10 wherein the protrusions and stops alternate around the shroud.

12. The light fixture of claim 1 wherein the shroud angles outwardly from the top surface of the housing.

13. A light fixture, comprising:

a housing having a wall extending from a bottom surface to a top surface and forming an opening, a top surface ridge having upper and lower radial and annular surfaces being connected to the top surface and externally of said housing;

a socket proximate the bottom surface for receiving an illumination source; and, a shroud removably secured to and extending away from the top surface, the shroud including a first stop extending radially inwardly from an inner surface of the shroud; and a second stop extending radially inwardly from the inner surface of the shroud and spaced from a rear surface of said shroud by an arm, the top surface ridge being received between the first and second stops.

14. The light fixture of claim 13, wherein the first and second stops extend substantially continuously along the inner surface of the shroud.

15. The light fixture of claim 13, wherein the shroud angles outwardly from the top surface of the housing.

16. The light fixture of claim 13, wherein the shroud extends axially from the top surface of the housing a distance to cover a compact fluorescent light secured within the socket extending past the end of the housing.

17. The light fixture of claim 13, wherein a distance between the first and second stops is at least as large as a thickness of the top surface ridge.

* * * * *